US005694864A

United States Patent [19]

Langewellpott

[11] Patent Number: 5,694,864

[45] Date of Patent: Dec. 9, 1997

[54] SCISSOR LIFT TABLE

[75] Inventor: Ernst Langewellpott, Wedemark, Germany

[73] Assignee: Johann Stamm, Wietze, Germany

[21] Appl. No.: 637,625

[22] PCT Filed: Oct. 24, 1994

[86] PCT No.: PCT/EP94/03486

§ 371 Date: Apr. 29, 1996

§ 102(e) Date: Apr. 29, 1996

[87] PCT Pub. No.: WO95/11852

PCT Pub. Date: May 4, 1995

[30] Foreign Application Priority Data

Oct. 27, 1993 [DE] Germany ..... 43 36 662.7

[51] Int. Cl.[6] ..... A47B 9/00

[52] U.S. Cl. ..... 108/145; 108/147

[58] Field of Search ..... 254/122; 108/145, 108/147

[56] References Cited

U.S. PATENT DOCUMENTS

| | | | |
|---|---|---|---|
| 2,993,675 | 7/1961 | Tatter | 108/145 |
| 3,277,501 | 10/1966 | Frisz et al. | 108/145 X |
| 3,290,008 | 12/1966 | White . | |
| 3,901,356 | 8/1975 | Butler . | |
| 3,917,211 | 11/1975 | Daunderer et al. | 108/145 X |
| 4,577,821 | 3/1986 | Edmo et al. | 108/145 |
| 4,638,610 | 1/1987 | Heikkinene | 108/145 X |
| 4,744,712 | 5/1988 | Mitchell | 108/145 X |
| 5,131,501 | 7/1992 | Yoshikawa . | |

FOREIGN PATENT DOCUMENTS

| | | | |
|---|---|---|---|
| 244539 | 1/1966 | Austria . | |
| 604156 | 10/1934 | Germany . | |
| 1175852 | 8/1964 | Germany . | |
| 3502641A1 | 7/1986 | Germany . | |
| 4106371A1 | 9/1992 | Germany . | |
| 4106371C2 | 9/1993 | Germany . | |
| 484648 | 2/1995 | Italy | 108/145 |

*Primary Examiner*—Jose V. Chen
*Attorney, Agent, or Firm*—Spencer & Frank

[57] ABSTRACT

A scissor lift table includes a pivot element, a first scissor element and a second scissor element having respective first ends and respective second ends, the center portions of the scissor elements being operatively joined with one another at the pivot element such that the scissor elements are pivotable counter to one another about the pivot element. A table plate is supported by the pair of scissor elements and a base supports the pair of scissor elements and has a top side. A drive arrangement is operatively connected to the scissor elements for pivoting the scissor elements counter to one another. The drive arrangement includes a geared motor; a horizontal threaded spindle, the geared motor operatively engaging the spindle at the end portion thereof; and a spindle nut operatively engaging the spindle at the body portion thereof, wherein one of the geared motor and the spindle nut is mounted on the pivot element. The scissor lift table further includes a single pair of guide elements having: respective first ends pivotally connected to respective ones of the scissor elements from a region within only one lateral scissor angle defined between the scissor elements; and respective second ends both pivotably connected to one of the spindle nut and the geared motor.

5 Claims, 2 Drawing Sheets

SCISSOR LIFT TABLE

FIELD OF THE INVENTION

The invention relates to a scissor lift table with scissor elements that cross each other in each other's centre portion, are pivotable counter to each other, support a table plate and are each rigidly but pivotably connected at one end with the base on the one hand, and the table plate on the other hand, and at their other end displaceably rest against the base and the underside of the table plate, with a drive means for pivoting the scissor elements counter to each other to lift or lower the table plate, said scissor lift table comprising an essentially horizontal threaded spindle running through the pivot axis of the scissor elements, which is drive-connected at one end with a geared motor and threadingly engages at the other end with a spindle nut, and with guide elements that are pivotable at both ends, the ends being mounted on the geared motor, and one the spindle nut on the one hand, and on respective the scissor elements on the other hand.

BACKGROUND OF THE INVENTION

A scissor lift table of type is disclosed in DE-OS 41 06 371. The prior art scissor lift table works perfectly, but requires improvement to render its construction more simple.

SUMMARY OF THE INVENTION

The invention has as its objects the task of creating a scissor lift table of the type mentioned above, which, whilst being of a relatively simple construction, offers the greatest possible lift between the minimum and maximum heights.

In a scissor lift table of the aforementioned type, the above object is achieved according to the invention in that one of the geared motor and the spindle nut is pivotably fixed to or mounted on the pivot element of the scissor elements, and in that the other one of the geared motor and the spindle nut is connected with each of the scissor elements from within one of the lateral scissor angles by means of each of the guide elements that are pivotable at both ends thereof.

Therefore, in contrast to the prior art solution, only two guide elements pivotable at both ends are needed because the spindle drive is fixed in the pivot element of the scissor elements.

The pivoting axis can either be fixed to the side of the geared motor or by the spindle nut.

BRIEF DESCRIPTION OF THE DRAWINGS

Preferred embodiments will be explained in more detail below, with reference to the enclosed drawings, in which.

DETAILED DESCRIPTION OF THE INVENTION

Figure 1:
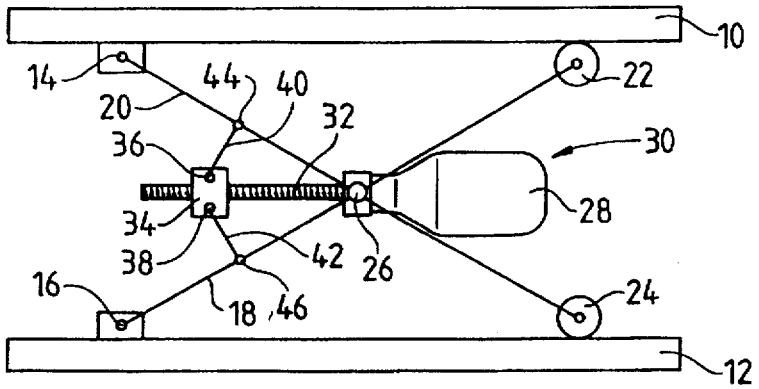
FIGS. 1 to 3 show three variations of a first embodiment of the invention.

FIG. 1 is a diagrammatic illustration of a scissor lift table comprising an upper table plate 10 and a lower base plate 12. The table plate and the base plate do not have to comprise closed plates. They can rather comprise suitable frame or support constructions.

On the left side of FIG. 1 there are, on the underside of the table plate 10 and on the upper side of the base plate 12, rigidly attached articulations 14, 16 in which two scissor elements 18, 20 that cross each other are pivotably mounted. The scissor element 18, which is pivotably fixed to the base plate, extends upwards at a slant with respect to the underside of table plate 10, against which it rests by means of a rotatable roller 22. 0n the other side, the other scissor element 20 extends from articulation 14 downwards to the base plate, on which it rests by means of roller 24. At the point where the two scissor elements 18, 20 cross they are connected by means of a pivot element 26 defining a pivot axis. Also pivotably fixed on the pivot element 26 is the housing 28 of a geared motor 30 from which, in FIG. 1, a threaded spindle 32 projects to the left and accommodates a spindle nut 34 on the body portion thereof. When the threaded spindle 32 is rotated with the aid of the geared motor 30, the spindle nut 34 is displaced to the left or to the right of FIG. 1.

On the spindle nut 34 in FIG. 1 there are upper and lower elements 36, 38 on which guide elements 40, 42 are pivotably mounted, whose other ends are connected via pivot elements 44, 46 to the two sections of the scissor elements 18, 20 to the left of the pivot element 26 in FIG. 1.

It is clear that when the spindle nut 34 is moved to the right in FIG. 1, the scissor elements 18, 20 are opened up by means of the guide elements 40, 42 and that if the spindle nut 34 is moved in the opposite direction, they are lowered into a flatter position.

This is equivalent to the raising and lowering movement of the scissor lift table.

It can be seen that FIG. 1 is only a diagrammatic representation. In practice, another pair of scissor elements is usually positioned behind the plane of the drawing in FIG. 1, and the drive device is located between the two pairs of scissor elements.

Figure 2:
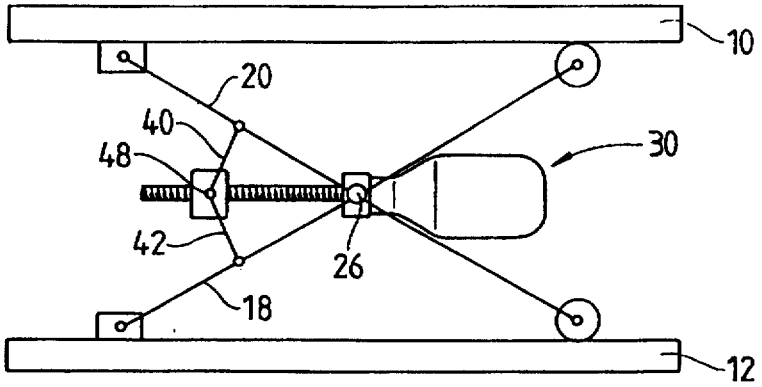

FIG. 2 largely coincides with FIG. 1, and hence the same reference numerals have been used for corresponding parts. The only difference with respect to FIG. 1 is that the two pivot elements 36, 38 on the spindle nut 34 as shown in FIG. 1 have been amalgamated to one single pivot element 48. This results in a certain lengthening of the two guide elements 40, 42, which leads to better kinematic ratios.

Figure 3:
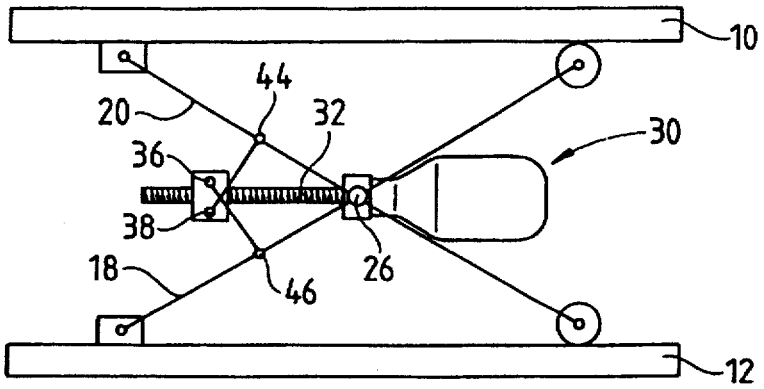

A further lengthening of the guide elements 40, 42 is shown in the embodiment of FIG. 3, in which the two guide elements 40, 42 are again mounted on the pivot elements 36, 38, but are mounted in a cross-over arrangement so that, for example, the guide element 40 leading up to the upper portion of scissor element extends from the lower pivot element 38 of the spindle nut 34.

The solution illustrated in FIGS. 1 to 3 requires only two guide elements with a total of four articulations and a relatively simple drive mechanism with a short threaded spindle 32.

Figure 4:
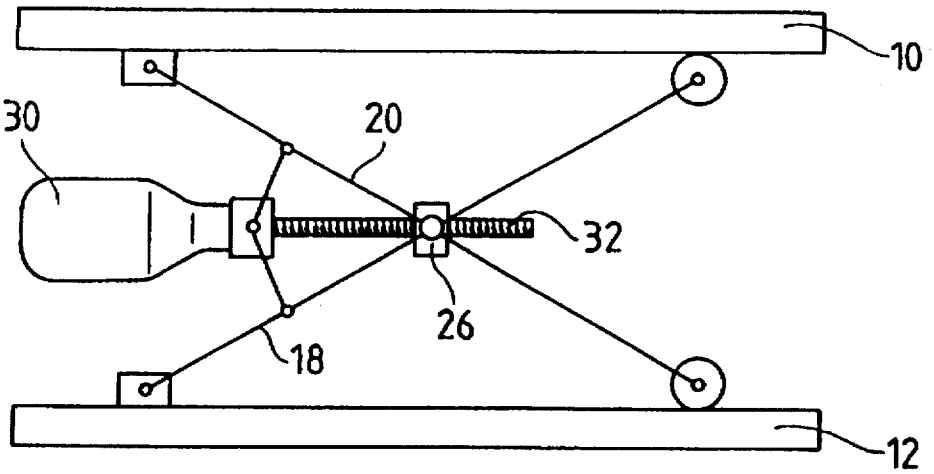
FIGS. 4 and 5 show two variations of a second embodiment of the invention.
Figure 5:
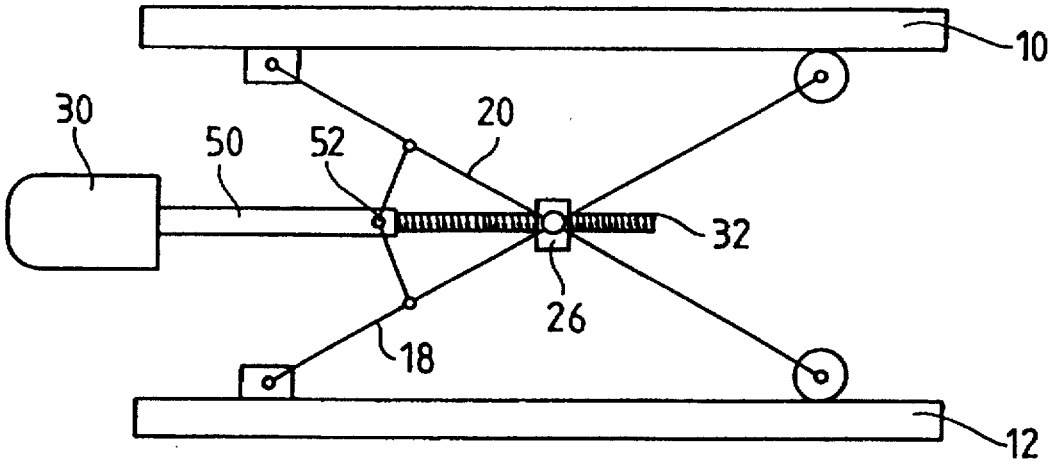

The same also applies to the solutions as shown in FIGS. 4 and 5. The same reference numerals have been used for corresponding parts in these drawings.

In FIG. 4, the orientation of the geared motor 30 and the threaded spindle 32 is the opposite of what it is in FIGS. 1 to 3. Hence the spindle nut 34 is pivotably fixed on the pivot element 26 of the two scissor elements 18, 20 whilst the geared motor 32 is located on the left side of FIG. 4. There are no other differences with respect to the embodiments described above.

FIG. 5 again fully coincides with FIG. 4, with the exception that the housing 28 of the geared motor 30 is lengthened by a sleeve 50 that encases the threaded spindle 32, on which, in this case, a pivot element 52 is located, on which the two guide elements 40, 42 are pivotably mounted. This solution offers the possibility of arranging the geared motor 30 to the side outside the area of the table plate 10, so that the geared motor does not obstruct a complete lowering of the table plate.

I claim:

1. A scissor lift table comprising:

a pivot element;

a first scissor element and a second scissor element, the scissor elements having respective first ends, respective second ends and respective center portions, the center portions being operatively joined with one another at the pivot element such that the scissor elements are pivotable counter to one another about the pivot element;

a table plate supported by the pair of scissor elements and having an underside;

a base supporting the pair of scissor elements and having a top side;

a drive means operatively connected to the scissor elements for pivoting the scissor elements counter to one another about the pivot element for effecting one of a lifting and a lowering of the table plate with respect to the base, the drive means comprising:

a geared motor;

a horizontal threaded spindle having an end portion and a body portion, the geared motor operatively engaging the spindle at the end portion thereof; and a spindle nut operatively engaging the spindle at the body portion thereof, wherein one of the geared motor and the spindle nut is mounted on the pivot element;

a single pair of guide elements, the guide elements having:

respective first ends pivotally connected to respective ones of the scissor elements from a region within only one lateral scissor angle defined between the scissor elements; and respective second ends both pivotably connected to one of the spindle nut and the geared motor.

2. The scissor lift table according to claim 1, wherein the second ends of the guide elements are pivotably connected to one of the spindle nut and the geared motor so as to define a common pivot axis for the guide elements.

3. The scissor lift table according to claim 1, wherein the second ends of the guide elements are pivotably connected to one of the spindle nut and the geared motor so as to define respective pivot axes for the guide elements.

4. The scissor lift table according to claim 1, wherein:

the geared motor comprises a housing and an elongated sleeve connected to the housing, the sleeve partially encasing the spindle therein;

the spindle nut is mounted on the pivot element; and the second ends of the guide elements are pivotally connected to the sleeve.

5. The scissor lift table according to claim 1, wherein:

the first end of the first scissor element is pivotably fixed to the underside of the table plate and the second end of the first scissor element displaceably rests against the top side of the base; and the first end of the second scissor element is pivotably fixed to the top side of the base and the second end of the second scissor element displaceably rests against the underside of the table plate.

* * * * *